United States Patent [19]

Luijten et al.

[11] Patent Number: 4,684,317

[45] Date of Patent: Aug. 4, 1987

[54] HIGH-VACUUM MOLECULAR PUMP

[75] Inventors: Waltherus J. T. H. Luijten; Johannes J. E. Moonen, both of Almelo, Netherlands

[73] Assignee: Ultra-Centrifuge Nederland N.V., Almelo, Netherlands

[21] Appl. No.: 670,646

[22] Filed: Nov. 13, 1984

[30] Foreign Application Priority Data

Nov. 16, 1983 [NL] Netherlands ..... 8303927

[51] Int. Cl.[4] ..... F04D 1/08; F04B 5/00

[52] U.S. Cl. ..... 415/73; 415/90

[58] Field of Search ..... 415/90, 72, 73, 244; 417/424

[56] References Cited

U.S. PATENT DOCUMENTS 940,103 11/1909 Feld ..... 415/90
2,569,563 10/1951 Grantham ..... 415/90

FOREIGN PATENT DOCUMENTS 242084 7/1925 Fed. Rep. of Germany ..... 415/90
633847 7/1936 Fed. Rep. of Germany ..... 415/72
2412624 10/1974 Fed. Rep. of Germany ..... 415/90

*Primary Examiner*—Carlton R. Croyle
*Assistant Examiner*—Theodore W. Olds
*Attorney, Agent, or Firm*—Cushman, Darby & Cushman

[57] ABSTRACT

The invention relates to a high-vacuum molecular pump of the kind comprising at least two coaxial elements (1 and 2) mounted rotatably with respect to each other and at a small distance from each other, wherein a side of one of the elements (1) positioned opposite a side of another element (2) is provided with at least one helical groove (5), and wherein a pump space (6) is present between these two sides of the elements, which pump space (6) is in communication with a gas supply (7) and a gas discharge (10, 8). Between the gas supply (7) and the pump space (6) a substantially annular gas supply chamber (9) is present, which is bounded by the elements (1 and 2) and which is relatively wide near the gas supply (7) but narrows downstream towards the pumpspace (6). The helical groove (5) extends into the annular gas supply chamber (9). According to the invention, blades (11, 11*a*) are mounted in the annular gas supply chamber (9), which blades (11, 11*a*) are attached to the side of an element (2) located opposite the helical groove (5) extending into the annular gas supply chamber (9).

5 Claims, 2 Drawing Figures

HIGH-VACUUM MOLECULAR PUMP

The invention relates to a high-vacuum molecular pump of the Holweck type.

Pumps of this kind, intended for creating and maintaining a very high vacuum, are known, for example from U.S. Pat. No. 1,492,846 and No. 2,730,297, British Pat. Specification No. 1,588,374 and from the article "A new molecular pump" by Louis Maurice in the "Japanese Journal of Applied Physics; suppl. 2, part 1, 1974, pages 21–24 Tokyo".

These pumps use the so-called "molecular drag" principle, which will be explained below.

When one of the elements (called the rotor for simplicity) rotates very rapidly relative to the other element (called the stator for simplicity), the following process will take place in the pump space between rotor and stator at a gas pressure which is so low that the free path of the gas molecules is longer than the dimensions of the pump space containing the molecules.

On average, each gas molecule that collides with the very rapidly rotating rotor will, on leaving the rotor surface, have, in addition to the velocity related to its temperature, a velocity component with the velocity magnitude and direction of that of the rotor surface. Because of the low gas pressure, a molecule leaving the rotor will not change its direction through collision with another molecule, but will finally collide with the side of the stator opposite the rotor and will rebound towards the rotor. This process keeps being repeated and results in the molecules moving in the rotor's direction of rotation. Because the side of the stator facing the rotor is provided with at least one helical groove, the result will be molecular transport in the direction of the groove. This is because the rotor's circumferential velocity can be resolved into two directions; parallel to the groove and perpendicular to it.

The compression ratio and the pumping speed are determined by, amongst other things, the velocity component of the molecules in the groove direction. The pumping speed is the number of volume units of gas in the low pressure space of the pump transported by the pump per unit of time.

It is clear that it is attractive to obtain a pumping speed which is as high as possible, while keeping the pump dimensions as compact as possible. This can be achieved by designing the pump so that the rotor can rotate at a very high speed, e.g. such that the circumferential speed of the rotor reaches values in the order of magnitude of 200 to 400 m/s. There are, of course, limits to the speed at which the rotor can rotate, since very high speeds create great mechanical problems. In addition, the construction should be such as to avoid leakage as far as possible.

The applicant's European Patent Application No. 82201601.0, published under publication No. 0081890 on 22nd June, 1983 discloses an improved embodiment of a high-vacuum molecular pump of the above-mentioned kind.

The high-vacuum molecular pump according to the above-mentioned European Patent Application comprises at least two coaxial elements mounted rotatably with respect to each other and at a small distance from each other, wherein a side of at least one of the elements positioned opposite a side of another element is provided with at least one helical groove, and wherein a pump space is present between these two sides of the elements, which pump space is in communication with a gas supply and a gas discharge, wherein near an end of a pair of elements a substantially annular gas supply chamber is present which is bounded by these elements, which annular gas supply chamber is in communication with the gas supply and with the pump space between the two elements, wherein the helical groove extends into the annular gas supply chamber, and wherein the elements which bound the annular gas supply chamber are so shaped that the annular gas supply chamber is relatively wide near the gas supply, but narrows downstream.

By employing this substantially annular gas supply chamber, which is relatively wide near the gas supply, the very fast moving gas molecules in the gas supply are effectively captured and transported by the high rotational speed. Owing to the special shape of the annular gas supply chamber, the captured molecules move gradually towards the pump space by a process of collision and impulse transfer as described above. This makes it possible, for a given rotor speed, to increase the pump speed in a simple manner.

The applicant has now found that the above-mentioned high-vacuum molecular pump, as disclosed in the applicant's above-mentioned European Patent Application, can be improved even further.

To this end this high-vacuum molecular pump is characterized according to the invention in that in the annular gas supply chamber are mounted blades which are attached to the side of an element located opposite the helical groove extending into the annular gas supply chamber.

In the construction as disclosed in the applicant's above-mentioned European Patent Application, the gas molecules which have entered the annular gas supply chamber collide with the walls of this chamber. The thermal effect will result in a molecule, after having spent a period of time on the wall in question, leaving this wall in a direction having a cosine distribution and with a speed which is related to the existing local temperature. Such a molecule could, after having left the wall, move in the direction of the gas supply of the annular gas supply chamber and could even leave the annular gas supply chamber and re-enter the gas supply. In other words, gas molecules can leak back from the annular gas supply chamber to the gas supply. This leak-back of gas molecules reduces the net pumping speed of the pump.

It has been found that this leak-back of gas molecules can be substantially reduced by, according to the invention, mounting blades in the annular gas supply chamber in the manner as described above.

The presence of the blades greatly reduces the chance of a gas molecule escaping from the annular gas supply chamber to the gas supply, since the blades would intercept such a gas molecule.

Some embodiments of the high-vacuum pump according to the invention will now be described with reference to the drawings, in which.

Figure 2:
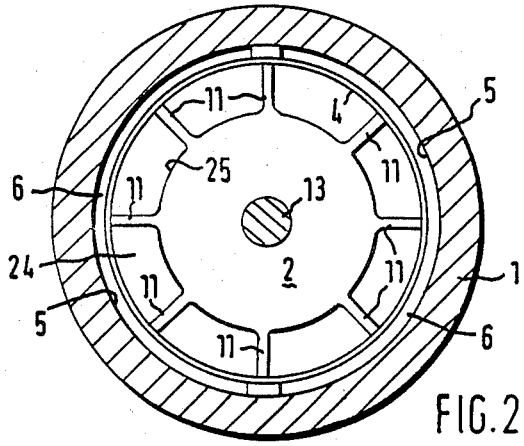
FIG. 2 is a view of a section I—I of the same pump.

The pump according to the invention comprises essentially two coaxial elements 1 and 2. The element 1 forms the stator and is a hollow, fixed casing 1. The element 2 is rotatably arranged within the element 1 and forms the rotor 2 of the pump.

The rotor 2 is rotatably mounted within the casing or stator 1 by means of bearings. To this end the rotor 2 is provided at its bottom with a shaft 12 and at its top with a shaft 13. The lower shaft 12 is supported by a suitable bearing 14 mounted in a cover 15. The cover 15 is attached to a support 16. This support 16 is attached to the casing 1. Within the support 16 is mounted a stator 17 of an electric motor which can interact with a rotor 18 of the same electric motor, said rotor 18 being fixed to the shaft 12.

The top shaft 13 is supported by a bearing 19. This bearing 19 is mounted in a cover 20 that, for example by means of bolts (not shown), is fixed to the top of the casing or element 1. The cover 20 comprises two concentric rings 21 and 22 joined together by a number of radial spokes 23 such that between the spokes 23 channels 7 are formed which function as gas supply.

The casing or element 1 is hollow and its inner side 3 can be substantially frusto-conical in shape. The side 3 is provided with at least one helical groove 5.

The outer side 4 of the element 2 is substantially circle-cylindrical. Between the juxtaposed sides 3 and 4 of the elements 1 and 2 respectively a pump space 6 is formed.

The pump space 6 communicates via an annular gas supply chamber 9 with the gas supply 7, which in this embodiment consists of the afore-mentioned channels 7 in the cover 20. A gas discharge 8 also communicates with the pump space 6 via an annular space 10.

The annular gas supply chamber 9 is located near an end of the elements 1 and 2. The annular gas supply chamber 9 is also bounded by the elements 1 and 2, the elements 1 and 2 which bound the annular gas supply chamber 9 being so shaped that the annular gas supply chamber 9 is relatively wide near the gas supply 7, but narrows downstream. The downstream direction in this context is the direction from the gas supply 7 to the pump space 6. The helical groove 5 extends into the annular gas supply chamber 9.

The narrowing of the annular gas supply chamber 9 in a downstream direction can be obtained in a number of ways. In the embodiment according to FIGS. 1 and 2 this results from the element 2 having at one end a part 24 whose outer surface is frusto-conically shaped, joined to a part 25 whose outer surface is circle-cylindrical.

In the annular gas supply chamber 9 blades 11 are mounted on the rotor 2. These blades 11 can be attached to the part 24 and to the part 25 of the rotor 2 in the manner shown in FIGS. 1 and 2. In the embodiment according to these drawings the blades 11 extend in a radial direction.

Figure 1:
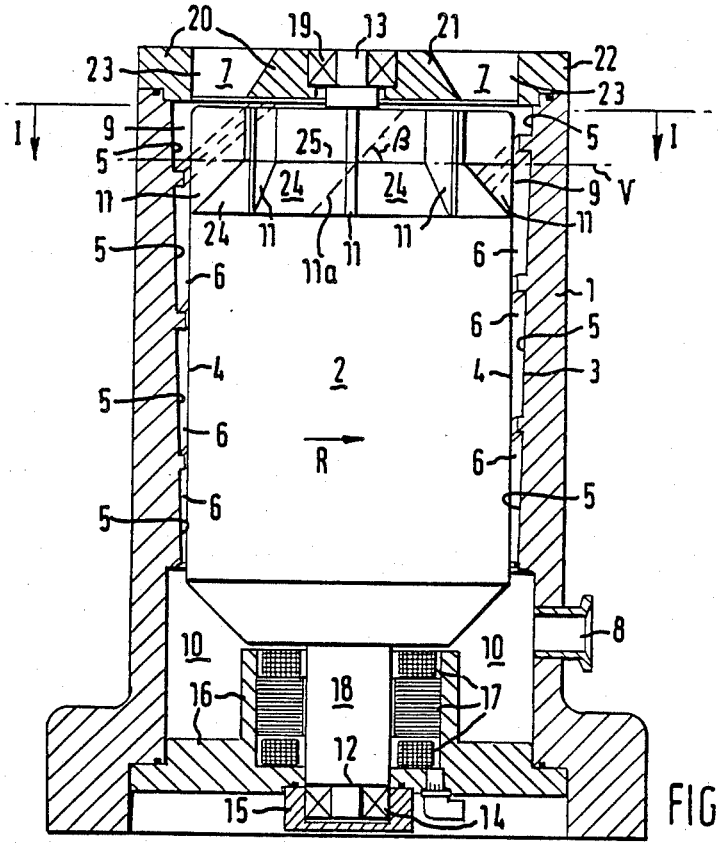
FIG. 1 is a longitudinal section of a pump according to the invention.

The blades can also be attached in a somewhat different manner to the rotor 2, as indicated by the broken line 11*a* in FIG. 1. The blades are then attached to the outer surface of the rotor 2 such that each blade 11*a*, viewed in the direction of rotation (see arrow R) of the rotor 2, makes an acute angle $\beta$ with a surface V perpendicular to the axis of rotation of the rotor 2. In other words, the blades are arranged in opposition to the grooves of the stator 1.

During normal use of the above-described pump, there will be a very low pressure in the suction side of the pump, i.e. in the gas supply 7. The gas molecules will move in the gas supply 7 with great speed, in the order of magnitude of 500 m/s (for $N_2$ at room temperature). As the annular gas supply chamber 9 is wide near the gas supply 7 (viewed in a radial direction), many molecules will enter the annular gas supply chamber 9.

The "captured" molecules will bounce backwards and forwards in the annular gas supply chamber 9 between the surfaces 24 and 25 of the rotor 2 and the inner side 3 of the stator 1 provided with the helical groove 5. In the process the rotor 2 will impart a velocity component to the molecules in the direction of rotation of the rotor 2. Because of the helical groove 5 extending into the annular gas supply chamber 9, the "captured" molecules in the annular gas supply chamber 9 will move to the pump space 6 as explained above.

Owing to the presence of the blades 11 or 11*a* in the annular gas supply chamber 9, the number of molecules leaking back from the annular gas supply chamber 9 to the gas supply 7 will be substantially reduced, as described above.

In the pump space 6 the molecules are similarly transported so that they finally reach the annular space 10 and the gas discharge 8.

Tests carried out by the applicant have shown that employment of the above-described annular gas supply chamber 9 fitted with blades 11 or 11*a*, results in a significant increase of the pumping speed for a given rotor speed.

In the described embodiment the side 4 of the rotor 2 is not provided with at least one helical groove, but, if deesired, the side 4 of the rotor 2 can also be provided with at least one helical groove. The windings of the helical grooves on the rotor and on the stator should then be in a mutually opposed direction.

In the described embodiments the blades 11 or 11*a* are oriented exactly radially, but it is also possible to mount the blades 11 or 11*a* on the surface 24 or 25 respectively of the rotor 2 such that each blade 11 or 11*a* makes an angle with the local tangent plane at the rotor which is different to 90 degrees.

The blades 11*a* can also be shaped such that they bound one or more helical grooves.

We claim:

1. High-vacuum molecular pump comprising at least two coaxial elements mounted rotatably with respect to each other about an axis and at a small distance from each other, wherein a side of at least one of the elements positioned opposite a side of another element is provided with at least one helical groove, and wherein a pump space is present between these two sides of the elements, which pump space is in communication with a gas supply and a gas discharge, wherein near an end of the pair of elements a substantially annular gas supply chamber is present which is bounded by the elements, which annular gas supply chamber is in communication with the gas supply and with the pump space between the two elements, wherein the helical groove extends into the annular gas supply chamber, and wherein the elements which bound the annular gas supply chamber are so shaped that the annular gas supply chamber is relatively wide near the gas supply, but narrows downstream, characterized in that in the annular gas supply chamber are mounted blades which are attached to the side of that element which is located opposite the helical groove extending into the annular gas supply chamber, the blades making an angle with a surface perpendicular to the axis of rotation, which angle is in the range between a right angle and an angle which is less than a right angle, and wherein said helical groove extends into said supply chamber to a position adjacent the blades.

2. High-vacuum molecular pump according to claim 1, characterized in that the juxtaposed sides of the elements are substantially surfaces of revolution, for example parts of cones and/or parts of cylindrical surfaces.

3. High-vacuum molecular pump according to claim 2, characterized in that one of the elements (the stator) is immovably fixed and that the other element (the rotor) is rotatably arranged within the stator, the blades being attached to the rotor.

4. High-vacuum molecular pump according to claim 3, characterized in that the blades extend in a radial direction.

5. High-vacuum molecular pump according to claim 3, characterized in that the blades are attached to the outside surface of the rotor such that each blade, viewed in the direction of rotation of the rotor, makes an acute angle with a plane perpendicular to the rotational axis of the rotor.

* * * * *